United States Patent [19]

Campbell et al.

[11] 4,303,750

[45] Dec. 1, 1981

[54] ALKALINE FLUID PHOTOGRAPHIC PROCESSING COMPOSITION CONTAINERS

[75] Inventors: John E. Campbell, Needham; Robert M. Delahunt, Norwell, both of Mass.

[73] Assignee: Polaroid Corporation, Cambridge, Mass.

[21] Appl. No.: 159,930

[22] Filed: Jun. 16, 1980

[51] Int. Cl.[3] ..... G03D 9/02

[52] U.S. Cl. ..... 430/208; 430/497; 430/449; 206/524.2; 206/524.3; 206/524.5

[58] Field of Search ..... 430/208, 497, 449, 464, 430/644; 206/524.2, 524.5, 524.3

[56] References Cited

U.S. PATENT DOCUMENTS

| | | | |
|---|---|---|---|
| 2,543,181 | 2/1951 | Land | 430/208 |
| 3,056,491 | 10/1962 | Campbell | 430/208 |
| 3,056,492 | 10/1962 | Campbell | 430/208 |
| 3,173,580 | 3/1965 | Campbell | 430/208 |
| 3,649,282 | 3/1972 | Campbell | 430/208 |
| 3,833,381 | 9/1974 | Chen | 430/208 |

*Primary Examiner*—John D. Welsh

*Attorney, Agent, or Firm*—John W. Ericson

[57] ABSTRACT

A rupturable pod for storing an aqueous alkaline photographic processing composition and dispensing the composition when ruptured, comprising an alkali resistant lining in contact with the processing composition and adhered to itself in regions forming a container enclosing the composition, a gas and moisture barrier of aluminum to prevent the passage of gas or moisture into or out of the container, and a resilient mechanical barrier layer positioned between and adhered to the aluminum and the lining.

4 Claims, 6 Drawing Figures

ALKALINE FLUID PHOTOGRAPHIC PROCESSING COMPOSITION CONTAINERS

This invention relates to photography, and particularly to a novel fluid container for storing and dispensing aqueous alkaline photographic processing compositions.

Rupturable containers for the storage and dispensing of aqueous alkaline photographic processing compositions are shown and described in U.S. Pat. Nos. 2,543,181; 3,056,491; 3,056,492; 3,649,282; and others. Containers of this kind are employed in photographic products such as the Polaroid SX-70 film units made and sold by Polaroid Corporation of Cambridge, Massachusetts. The basic requirements of such a container are that it exclude oxygen from the processing composition, and prevent the escape of any appreciable quantity of water, until the composition is to be dispensed.

Fluid containers disclosed in the above-cited patents essentially comprise an outer layer of paper, a polyester or the like adhered to a metal foil that serves as the required gas barrier. The metal foil is adhered to a liner of a material such as polyvinyl chloride that is in contact with the processing composition and functions to prevent contact between the processing composition and the metal foil gas barrier.

Metal foils of lead, aluminum and silver have been proposed for use in containers of the kind here considered. Of these, only lead foil has previously been commonly employed. Lead is reasonably stable in the presence of aqueous alkaline compositions in the absence of oxidizing agents, such as oxygen, although pinholes in the liner must be avoided to prevent reactions that might occur over extended periods of storage. As noted in U.S. Pat. No. 3,649,282, contact between lead and the processing composition may lead to reactions producing a black product on a photographic layer processed with the composition. However, it has been found that this problem can be effectively prevented with a vinyl liner.

Aluminum foil would be a highly desirable replacement for lead foil in processing fluid containers. Aluminum is not only considerably less expensive than lead on a weight basis, but is much lighter and can be obtained in reasonably pinhole-free foils of about one-half the thickness of a lead foil with an equivalent pinhole population. However, aluminum reacts readily with aqueous alkaline compositions, forming an aluminate and gaseous hydrogen. As pointed out in U.S. Pat. No. 3,649,282, the hydrogen produced in such a reaction could cause rupture of the container.

In U.S. Pat. No. 3,649,282, it is proposed to include an acid reacting layer between a foil of lead or aluminum and a vinyl liner to trap migrant alkali and prevent contact with the foil. However, this expedient has been found unnecessary with lead foil. And in view of the considerably more serious consequences of a failure with aluminum, it has not been considered sufficiently reliable for commercial use.

The object of this invention is to provide a container of aqueous alkaline processing composition including an aluminum gas and moisture barrier in which the aluminum is isolated from the alkaline composition to a degree that makes negligible the probability of any reaction between alkaline components of the composition and the aluminum.

Briefly, the above and other objects of the invention are attained by a novel fluid container formed from a laminate comprising an aluminum foil gas and moisture barrier, an alkali-resistant, thermoplastic lining forming the inner wall of the container, and a tough resilient mechanical barrier layer positioned between and adhered to the aluminum foil and to the thermoplastic lining by intermediate layers of adhesives substantially inert to alkali. The mechanical barrier layer serves to preclude mechanical intrusion of the aluminum gas barrier into processing fluid in the container, particularly during formation of the container. Preferably, an outer cover comprising paper is adhered to the aluminum.

The invention will best be understood in the light of the following detailed description, together with the accompanying drawings, of various illustrative embodiments of the invention.

Figure 1:
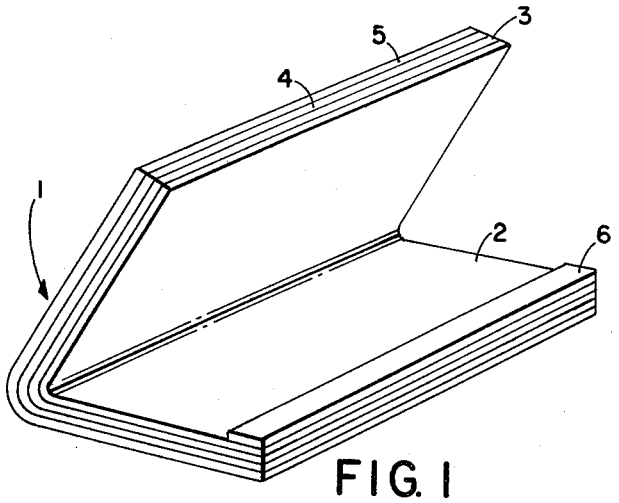
FIG. 1 is a schematic perspective sketch of a blank useful in forming a container in accordance with the invention.

FIG. 1 shows a blank 1 useful in forming rupturable fluid containers in accordance with the invention. In general, the blank 1 comprises a laminate including an alkali resistant thermoplastic lining 2 of material chosen to be stable in contact with the processing composition to be enclosed and to be capable of forming a liquid impermeable seal with itself in selected regions to which heat and pressure are applied. The lining 2 may be a conventional vinyl pod lining material capable of being sealed to itself under heat and pressure and serving as an inert barrier to the passage of aqueous alkaline photographic processing compositions; e.g., vinyls such as polyvinyl chloride, polyvinyl butyral and the like as described in the above cited patents.

Adhered to the lining 2 is a mechanical barrier layer 3 of tough resilient material resistant to puncture, shock and flow during the sealing operations; e.g., a polyester such as polyethylene terephthalate, on the order of 0.25 to 0.75 mils in thickness. Among other suitable materials are oriented polypropylene, nylon and high melting polyethylene. Polyethylene is particularly desirable for its resistance to aqueous alkali. The mechanical barrier layer 3 is adhered to an aluminum gas and moisture barrier layer 4 by an adhesive that is inert to alkali.

An outer cover 5 may be and preferably is adhered to the aluminum layer 4 for various purposes, as to contribute mechanical strength to the laminate, to impart a desired external appearance to the container, and the like.

A stripe 6 of a selected sealant is adhered to one edge of the lining 2. When the blank 1 is folded over so that the opposite edge of the lining 2 contacts the stripe 6, and heat, pressure, or both are applied, the stripe 6 serves to adhere the opposed edges of the lining 2 together to form a preferentially rupturable seal in the manner and for the purposes fully described in the above-cited patents. As there discussed, the sealant 6 is selected to form a bond weaker than the bond formed by sealing the ends of the lining 2 together, so that pressure applied to the finished container will cause the container to open preferentially only along the edge sealed by the stripe 6. Alternatively, if so desired, the weaker seal region can be attained without the use of a stripe 6, by sealing the liner material to itself in this area under lower temperatures and/or pressures than those used in forming the other seals, as described in U.S. Pat. No. 3,173,580.

Figure 2:
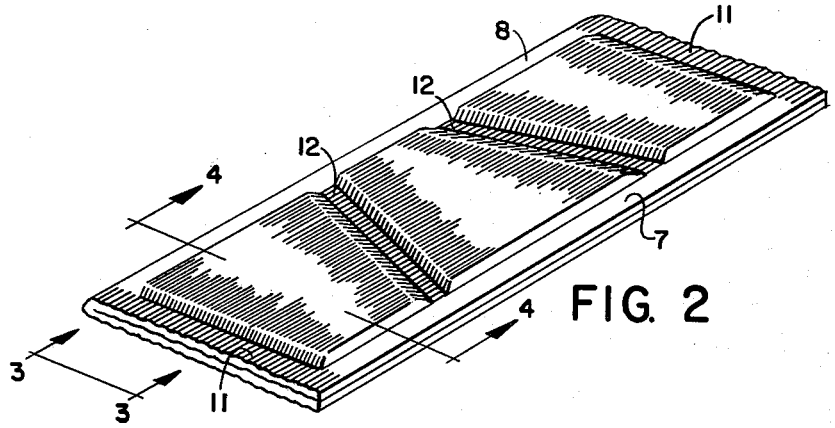
FIG. 2 is a schematic perspective sketch of a completed container made from a blank such as that shown in FIG. 1 and filled with processing composition.
Figure 3:
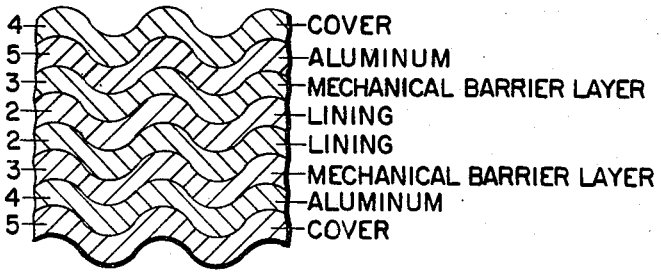
FIG. 3 is a fragmentary view, on an enlarged scale, of one end of the container of FIG. 2 as seen essentially along the lines 3—3 in FIG. 2.
Figure 4:
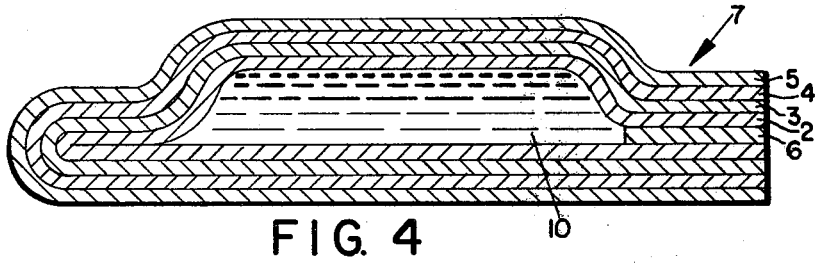
FIG. 4 is a cross-sectional view of the container of FIG. 2 taken essentially along the lines 4—4 in FIG. 2 on a vertical scale enlarged relative to the horizontal scale.

The blank 1 is folded over with the lining 2 on the inside, and sealed along edge 7 as indicted in FIGS. 2, 3 and 4. Preferably, the blank is also sealed along the folded edge 8, as is known in the art. (Alternatively, two separate sheets could be joined by seals 8 and 9 along both edges in lieu of using a folded sheet.) As described in U.S. Pat. No. 3,649,282, up to this stage in manufacture, the blank 1 may be part of a longer length of laminate.

The tube formed by sealing the blank along the edges 8 and 9 is next filled with aqueous alkaline processing composition 10. The container may then be closed by applying heat and pressure along the ends to form non-rupturable seals as indicated at 11, preferably while crimping the edges as best shown in FIG. 3. If desired, for various purposes known to the art, such as controlling the distribution pattern of processing composition when the container is ruptured, one or more intermediate, non-rupturable seals, as at 12, may be formed between selected confronting regions of the lining 2 and/or at spaced intervals along the rupturable seal 7. The particular arrangement of seals 11 shown in FIG. 2 corresponds to that shown and described in U.S. Pat. No. 3,833,831; such seals 11 divide the pod into three separate compartments. In other known arrangements, communicating passages allow flow between or around the intermediate, non-rupturable seals. The presence or absence of such intermediate seals, and their location if present, will be determined on the basis of considerations known to the art and not necessary to an understanding of this invention.

The barrier layer 3 should be non-flowing at the temperatures and/or pressures used in forming and sealing the container, to prevent portions of it from being squeezed out in the seal area, thus permitting contact between the alkaline processing composition and the metal, or to allow the barrier layer to become so thin as to permit the flow or diffusion of reactive components of the composition into contact with the metal.

It will be recognized that the so-called "end seals" 11 are formed under conditions of temperature and pressure such that at least the facing surface portions of the alkali-impervious lining 2 fuse or soften and also tend to flow outwardly. As a result, the strata of the lining 2 in the end seals 11 may be significantly thinner than in areas not subjected to such vigorous sealing conditions; indeed, in extreme cases a predominant portion of this thermoplastic lining may be displaced. Where the end seals 11 also are subject to a crimping step to increase the seal strength, there is a real possibility that a portion of the aluminum foil may penetrate the vinyl lining 2 and be brought into contact, either immediately or with the passage of time, with the processing composition or with traces thereof entrapped during the sealing step. The provision of the mechanical barrier layer 3 substantially reduces the possibility of such a defective seal; this desirable improvement is believed to be due to the fact that the barrier layer 14 does not undergo any significant flow or thinning during the sealing step and/or that it acts to "cushion" the pressure from the crimping/sealing dies.

Figure 5:
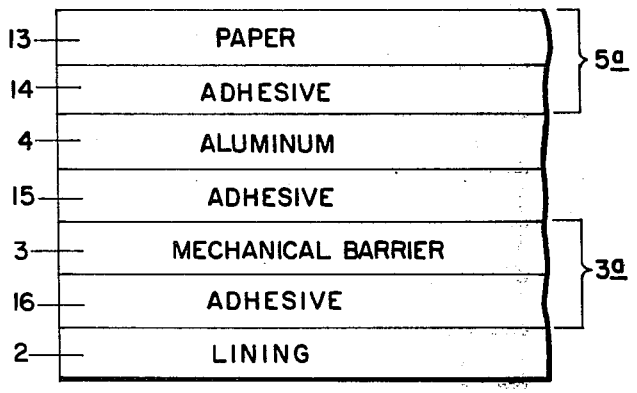
FIG. 5 is a fragmentary diagrammatic elevational sketch of a laminate useful in forming containers in accordance with one embodiment of the invention.

FIG. 5 shows a laminate in accordance with one embodiment of the invention suitable for the construction of fluid containers of the type described in connection with FIGS. 1–4. As shown, the cover **5*a* preferably comprises a sheet of paper 13, such as a tissue paper about 1 to 2 mils (around 25–55 microns) in thickness, adhered to the aluminum layer 4 by any suitable adhesive 14**.

The paper 13 provides strength to allow the laminate to be manipulated through the various steps in the construction of the finished container. In addition, it may be selected for color; for example, a desired shade of white to match the border of a photographic product of which the container is to form a part.

The adhesive 14 may be selected from any of those known in the art for the adhesion of paper to metal, but is preferably a cross-linkable polyester adhesive such as Adcote 503A, made and sold by Morton Chemical Company, of Chicago, Illinois, with a suitable catalyst added prior to application. In accordance with one embodiment of the invention, the layer 4 is of aluminum foil from 0.25 to 1.0 mils in thickness, and the 503A adhesive is coated on the foil in a suitable solvent such as methyl ethyl ketone. The solvent is removed by drying, and the coated foil is laminated to the paper under heat and pressure. The adhesive is coated to a dry weight of about 3 pounds per ream (about 5 grams per square meter) in accordance with a particular and presently preferred embodiment of the invention, though lesser or greater coverages may be employed so long as adequate adhesion is obtained.

A mechanical barrier layer 3 of tough, resilient material resistant to puncture, shock and flow during the sealing operations is interposed between the aluminum layer 4 and the lining 2. The barrier layer 3 may be adhered to the aluminum layer 4 and to the lining 2 by any suitable conventional adhesives 15 and 16.

The adhesives 15 and 16 may be chosen for adhesion both to the aluminum layer 4, or the lining 2, and to the mechanical barrier 3, for which purposes a cross-linked polyester such as Adcote 503A is well suited where the lining 2 is polyvinyl chloride, and the mechanical barrier layer 3 is polyethylene terephthalate. The adhesives 15 and 16 should be essentially inert to alkali. A presently preferred material for this purpose is a mixture of equal parts by weight of a carboxylated vinyl resin and a nitrile rubber comprising a copolymer of butadiene and acrylonitrile with a relatively high ratio of acrylonitrile to butadiene, preferably applied to the metal substrate from a suitable solvent. A preferred composition is made as a solution in a suitable solvent, such as methyl ethyl ketone or other conventional nitrile rubber solvent, of a mixture of the nitrile rubber with a copolymer of a vinyl chloride and vinyl acetate modified by the addition of carboxyl groups, as by the addition of about 1 percent of maleic acid to an 86/13 weight ratio vinyl chloride/vinyl acetate monomer mixture before copolymerization. The nitrile rubber may be a non-cross-linked butadiene/acrylonitrile and 59 parts by weight of butadiene. The weight ratio of nitrile rubber/carboxylated vinyl may be from 25/75 to 75/25, and is preferably 50/50. A presently preferred composition is available as Bostik 4048 adhesive, as made and sold by Bostik Division, USM Corporation, of Middleton, Massachusetts.

Additional peel strength, or resistance to delamination, between the mechanical barrier 3 and adjacent structure may be provided by including a thin primer coat, e.g., 1 to 3 microns, of an adhesive chosen primarily for its adhesion to the mechanical barrier 3 and to the adjacent layers 2 and 4. For example, if the mechanical barrier layer is of polyethylene terephthalate, and the adhesive layers 15 and 16 are of a nitrile rubber-carboxylated vinyl composition, a primer coat of a cross-linkable polyester, such as Adcote 1069, as made and sold by Morton Chemical Company of Chicago, Illinois, on both surfaces of the layer 14 will materially increase adhesion. A catalyst is added to this material prior to coating in accordance with the manufacturer's instructions.

Figure 6:
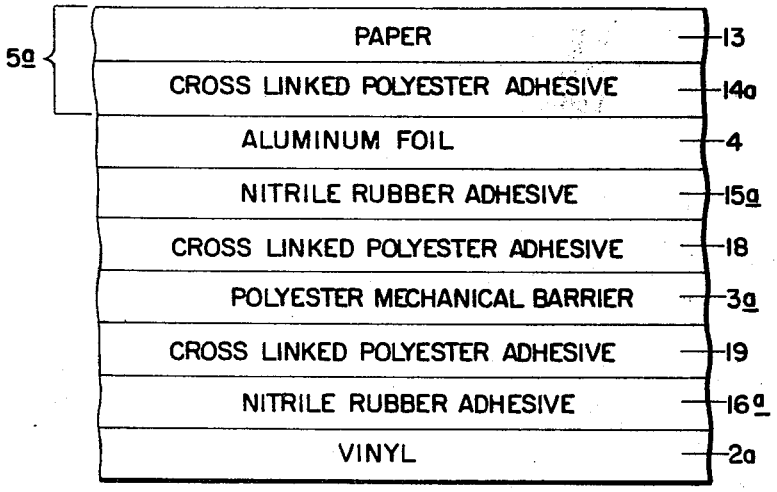
FIG. 6 is a fragmentary diagrammatic elevational sketch of a laminate useful in forming containers in accordance with another embodiment of the invention.

FIG. 6 shows a laminate presently preferred for its high strength, alkali resistance, and resistance to delamination or puncture. The several layers of the structure may be of the preferred materials described above. The preferred cross-linked polyester adhesive layers are shown at 14*a*, 18 and 19. The method presently contemplated for the manufacture of the laminate of FIG. 6 is as next described.

In a particular and presently preferred embodiment, a 0.5 mil sheet of polyethylene terephthalate, shown at 3*a* in FIG. 6, is coated with a solution of Adcote 1069 polyester adhesive in methyl ethyl ketone, to a dry coating weight of 1 to 2 pounds per ream, and dried to remove the solvent. The layer 18 of adhesive primer is next coated with a solution of Bostik 4048 nitrile rubber adhesive in methyl ethyl ketone to a dry coating weight of 4 pounds per ream, and dried to remove the solvent. A sheet of aluminum foil 4, 0.5 mils in thickness, is then laminated under heat and pressure to the adhesive layer 15*a* of the laminate 3*a*, 18, 15*a*, accelerating the cross-linking of the polyester adhesive layer 18 in the process. Next, a coating 14*a* of 3 pounds per ream of Adcote 503A adhesive is applied from a solvent solution as described above, and laminated under heat and pressure to a 1.2 mil sheet of white tissue paper 13, removing the solvent and accelerating the cure of the adhesive 14*a* in the process.

The laminate 13, 14*a*, 4, 15*a*, 18, 3*a* is now solvent coated with a priming layer 19 of Adcote 1069 polyester adhesive and dried to remove the solvent. A dried coating weight of 1 to 2 pounds per ream is adequate. Over the layer 19 is solvent coated a layer 16*a* of the same nitrile rubber adhesive used to form the layer 15*a* to a dry coating weight of 4 pounds per ream. After drying to remove the solvent, a 1 mil sheet of 85/15 vinyl chloride-vinyl acetate copolymer 2*a* is laminated to the adhesive layer 16*a* under heat and pressure to produce the final laminate.

Pods of processing composition made in accordance with the preferred embodiment of the invention as just described have been tested by shelf storage for five months and shown to have performed equivalently to lead foil couterparts in terms of ease of processing into pods, sensitometric compatibility with black and white and color photosensitive products, and ability to contain developer at a low loss rate; i.e., 0.5 to 1.0 percent weight loss per year.

While the invention has been described with reference to the details of various specific illustrative embodiments, many changes and variations will occur to those skilled in the art upon reading this description, and such can be made without departing from the scope of the invention.

Having thus described the invention, what is claimed is:

1. A photographic product comprising a rupturable container holding an aqueous alkaline photographic processing composition, said container comprising a laminar pouch having a lining in contact with said processing composition; and a layer of aluminum foil adhered to said lining; said lining consisting essentially of an alkali barrier layer of alkali resistant polymeric material between said processing composition and said metal foil, a tough resilient mechanical barrier layer of puncture and flow resistant polymeric material between said alkali barrier layer and said layer of aluminum foil, and a layer of adhesive inert to alkali adhering said barrier layer to said aluminum foil.

2. A photographic product comprising a rupturable container holding an aqueous alkaline photographic processing composition, said container comprising a laminar pouch having an alkali resistant thermoplastic lining in contact with said processing composition, a layer of aluminum foil, and a tough resilient mechanical barrier layer of puncture and flow resistant polymeric material between said lining and said layer of aluminum foil and adhered thereto solely by adhesives inert to alkali.

3. A photographic product comprising a rupturable container holding an aqueous alkaline photographic processing composition, said container comprising a laminar pouch having an alkali resistant thermoplastic lining in contact with said processing composition; a layer of aluminum foil; a tough resilient mechanical barrier layer of puncture resistant polymeric material selected from the class consisting of polyesters, oriented polypropylene, nylon and polyethylene between and adhered to said aluminum foil layer and said lining, said barrier layer being adhered to said foil by an intermediate layer consisting essentially of adhesive substantially inert to alkali.

4. A photographic product comprising a rupturable container holding an aqueous alkaline photographic processing composition, said container comprising a laminar pouch having a thermoplastic vinyl lining in contact with said processing composition, said lining being sealed to itself to enclose said processing composition in first seal regions and at least one preferentially rupturable second region; a layer of aluminum foil; a paper cover adhered to said aluminum foil; a barrier layer of alkali resistant polymeric adhesive material between said processing composition and said metal foil, a tough resilient mechanical barrier layer of puncture and flow resistant polymeric material between said alkali barrier layer and said layer of metal foil, said mechanical barrier layer being adhered to said metal foil layer soley by adhesives substantially inert to alkali, and a vinyl layer in contact with said processing composition.

* * * * *